US012560352B2

(12) United States Patent
Zemborain

(10) Patent No.: US 12,560,352 B2
(45) Date of Patent: Feb. 24, 2026

(54) DUAL LOUVER ARRANGEMENT

(71) Applicant: Electrolux Appliances Aktiebolag, Stockholm (SE)

(72) Inventor: Pedro Zemborain, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 405 days.

(21) Appl. No.: 18/021,436

(22) PCT Filed: Aug. 24, 2020

(86) PCT No.: PCT/EP2020/073641

§ 371 (c)(1),
(2) Date: Feb. 15, 2023

(87) PCT Pub. No.: WO2022/042819

PCT Pub. Date: Mar. 3, 2022

(65) Prior Publication Data

US 2023/0296285 A1 Sep. 21, 2023

(51) Int. Cl.
*F24F 13/14* (2006.01)
*F24F 1/0003* (2019.01)

(52) U.S. Cl.
CPC ..... *F24F 13/1413* (2013.01); *F24F 1/0003* (2013.01); *F24F 13/1426* (2013.01); *F24F 2013/1433* (2013.01)

(58) Field of Classification Search
CPC .. F24F 13/1413; F24F 1/0003; F24F 13/1426; F24F 2013/1433; F24F 1/0011; F24F 2013/221; F24F 1/007; F24F 13/22
USPC ..... 454/314
See application file for complete search history.

(56) References Cited

FOREIGN PATENT DOCUMENTS

| | | | | | |
|---|---|---|---|---|---|
| CN | 201007527 | Y | | 1/2008 | |
| CN | 203907924 | U | | 10/2014 | |
| CN | 104279734 | A | * | 1/2015 | ..... F24F 1/0011 |
| CN | 207880963 | U | | 9/2018 | |
| CN | 110220291 | A | * | 9/2019 | ..... F24F 1/0011 |
| CN | 110425719 | A | * | 11/2019 | ..... F24F 11/79 |
| KR | 20190051676 | A | * | 5/2019 | ..... F24F 13/1413 |

(Continued)

OTHER PUBLICATIONS

Machine Translation of CN 104279734 (Year: 2015).*

(Continued)

*Primary Examiner* — Allen R. B. Schult
*Assistant Examiner* — Amy E Carter
(74) *Attorney, Agent, or Firm* — Bradley Arant Boult Cummings LLP

(57) ABSTRACT

A louver arrangement configured to be attached to an air-conditioner is provided. The louver arrangement comprises a, first, main louver, and a, second, crank louver. The main louver and the crank louver are rotatably connected to each other. Hereby the main louver and crank louver work in cooperation. The main louver is configured to direct a main air flow from an air-conditioner outlet when mounted on an air-conditioner, and the crank louver is configured to be located closer to a lower wall of the air-conditioner outlet when mounted on an air-conditioner and configured to, at least in some positions, to enable deflection of a fraction of air flow onto the main louver when in use on the air-conditioner.

17 Claims, 7 Drawing Sheets

(56) References Cited

FOREIGN PATENT DOCUMENTS

| | | | | | |
|---|---|---|---|---|---|
| KR | 20190052387 A | * | 5/2019 | ..... | F24F 1/0011 |
| KR | 20190052388 A | * | 5/2019 | ..... | F24F 1/0011 |

OTHER PUBLICATIONS

KR 20190051676 with Machine Translation (Year: 2019).*
KR 20190052387 with Machine Translation (Year: 2019).*
Machine Translation of CN 110220291 (Year: 2019).*
Machine Translation of CN 110425719 (Year: 2019).*
Machine Translation of KR 20190052388 (Year: 2019).*
International Search Report and Written Opinion for International Application No. PCT/EP2020/073641, dated May 6, 2021, 10 pages.
Office Action dated Mar. 19, 2025 of corresponding Chinese Patent Application No. 202080103284.0.
Office Action dated Aug. 28, 2025 of corresponding Chinese Patent Application No. 202080103284.0.

* cited by examiner

DUAL LOUVER ARRANGEMENT

This application is a U.S. National Phase application of PCT International Application No. PCT/EP2020/073641, filed Aug. 24, 2020, which is incorporated by reference herein.

TECHNICAL FIELD

The invention relates to an air conditioner. The present invention also relates to a louver arrangement configured to be attached to an air-conditioner. The louver arrangement can be used to adjust the output air flow from the air-conditioner.

BACKGROUND

Air conditioning is a collective expression for conditioning air into a desired state. It could be heating the air during cold periods, cooling the air during warmer periods or for cleaning the air if it contains unwanted particles. However, the expression air conditioning is most often used when emphasizing cooling. As a product, air conditioners can look and be used in various ways, but they all share the same basic technology. The air-conditioner comprises a compressor, a condenser, an evaporator, and typically also an expansion device.

There are different types of air-conditioners. One type of air-conditioner can be referred to as a split air-conditioner. In a split air conditioner, the condenser and the evaporator are located in two different separated units that are interconnected via pipes to circulate a refrigerant from one unit to the other.

Another type of air-conditioner can be referred to as a Packaged Air Conditioner. A Packaged Air Conditioner (AC) can be said to be a type of self-contained system, in which all the cooling cycle components, such as the compressor, condenser, expansion device, evaporator and control system are enclosed in a single package.

In any case, the final output from the air-conditioner is conditioned air blown into a room or some other space. It is typically desired that the air is delivered at low noise, in a sufficient amount and also the process of delivering air should be energy efficient.

To direct the air into the room a so-called louver can be used at the air output from the air-conditioner. Thus, a louver can be described as a movable element provided to displace air blown by a fan of the air-conditioner. One or more such movable elements or louvers can be provided at the air outlet. The louver(s) can deflect the air stream and aim it at a specific direction.

Louvers are of particular importance in air conditioning/heat pump units, where the ability to deliver the conditioned air in different directions can significantly improve the performance of the air-conditioner and the user comfort.

In accordance with some implementations, one horizontal louver which can be adjusted (automatically or manually) to direct the air up and down is combined with a number of vertical louvers which can be adjusted (automatically or manually to direct the air from side to side. This will allow a 3-dimensional air directing.

There is a constant desire to improve air conditioners. Hence, there exists a need for an improved air conditioner and also to a louver for an air-conditioner.

SUMMARY

It is an object of the present invention to provide an improved air-conditioner. In particular, it is an object to improve use and maintenance of an air-conditioner provided with a louver. It is a further object of the present invention to provide an improved louver arrangement for an air-conditioner.

These objects and or others are obtained by an air conditioner and a louver arrangement as set out in the appended claims.

In accordance with the invention a louver arrangement configured to be attached to an air-conditioner is provided. The louver arrangement comprises a, first, main louver, and a, second, crank louver. The main louver and the crank louver are rotatably connected to each other. Hereby the main louver and crank louver work in cooperation. The main louver is configured to direct a main air flow from an air-conditioner outlet when mounted on an air-conditioner, and the crank louver is configured to be located closer to a lower wall of the air-conditioner outlet when mounted on an air-conditioner and configured to, at least in some positions, to enable deflection of a fraction of air flow onto the main louver when in use on the air-conditioner.

This is advantageous for example when the air-conditioner is in a cooling mode. Then the main louver can be positioned in the area of fastest moving air in the air conditioner air outlet and be responsible of directing the air flow. The crank louver being positioned closer to the lower wall of the air outlet can then have the function of directing slow moving air in that area of the air outlet of the air-conditioner in a way that helps prevent condensation on the main louver under certain temperature and humidity conditions and can also act to improve the overall air flow from the air outlet of the air-conditioner.

In accordance with one embodiment, a louver link connecting the main louver to the crank louver and a slot connected to the main louver is provided. Hereby an easy to implement mechanism for moving the main louver and crank louver can be obtained.

In accordance with one embodiment, a slide crank is provided, the slide crank has a member at one end adapted to slide in the slot. This can facilitate the movement of the main louver. The slide crank at a second end can be provided with a first rotating member.

In accordance with one embodiment, a second rotating member attached to the louver link is provided. Hereby the louver arrangement can be easily removed in one piece.

In accordance with some embodiments, the first rotating member and/or the second rotating member is connected to a stepper motor. Hereby the louver arrangement can be motor driven and positioned in different modes of operation without manually operating the louver arrangement.

In accordance with one embodiment, the crank louver has a bent cross-section. Hereby air can be made to flow on both sides of the crank louver. This is particularly beneficial when the louver arrangement is in a position for air cooling since condensation then can be reduced or eliminated on the crank louver. For example, the crank louver can have an S-shaped cross-section.

In accordance with one embodiment, the crank louver and the louver link are formed as an integrated element. Hereby manufacturing and assembly can be facilitated.

In accordance with one embodiment, at least two louver links are provided along the length of the main louver. By repeating the louver link multiple times such as two or three or four times over the length of the main louver, stability can be improved.

The invention also relates to an air-conditioner comprising a louver arrangement as set out above. The air-conditioner can be provided with the louver arrangement at the air-outlet of the air-conditioner.

In accordance with one embodiment, when the louver arrangement comprises a first and a second rotating member and when a stepper motor is connected to each of the first and second rotating member, wherein both stepper motors are located at an end section of the louver arrangement. Hereby assembly is greatly facilitated since the louver arrangement can be snapped on to the motors. Also, the motors can be located close to a controller used to control the motors and wiring and to the motors is facilitated.

BRIEF DESCRIPTION OF THE DRAWINGS

The invention will now be described in more detail, by way of example, and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. For example, like or similar components of different embodiments can be exchanged between different embodiments. For example, the louver arrangement as described herein is shown mounted on an indoor unit of a split air-conditioner, but the louver could equally be mounted on any type of air conditioner. Some components can be omitted from different embodiments. Also, some components typically used in an air-conditioner have been omitted to more clearly show the invention. Like numbers refer to like elements throughout the description.

Figure 1:
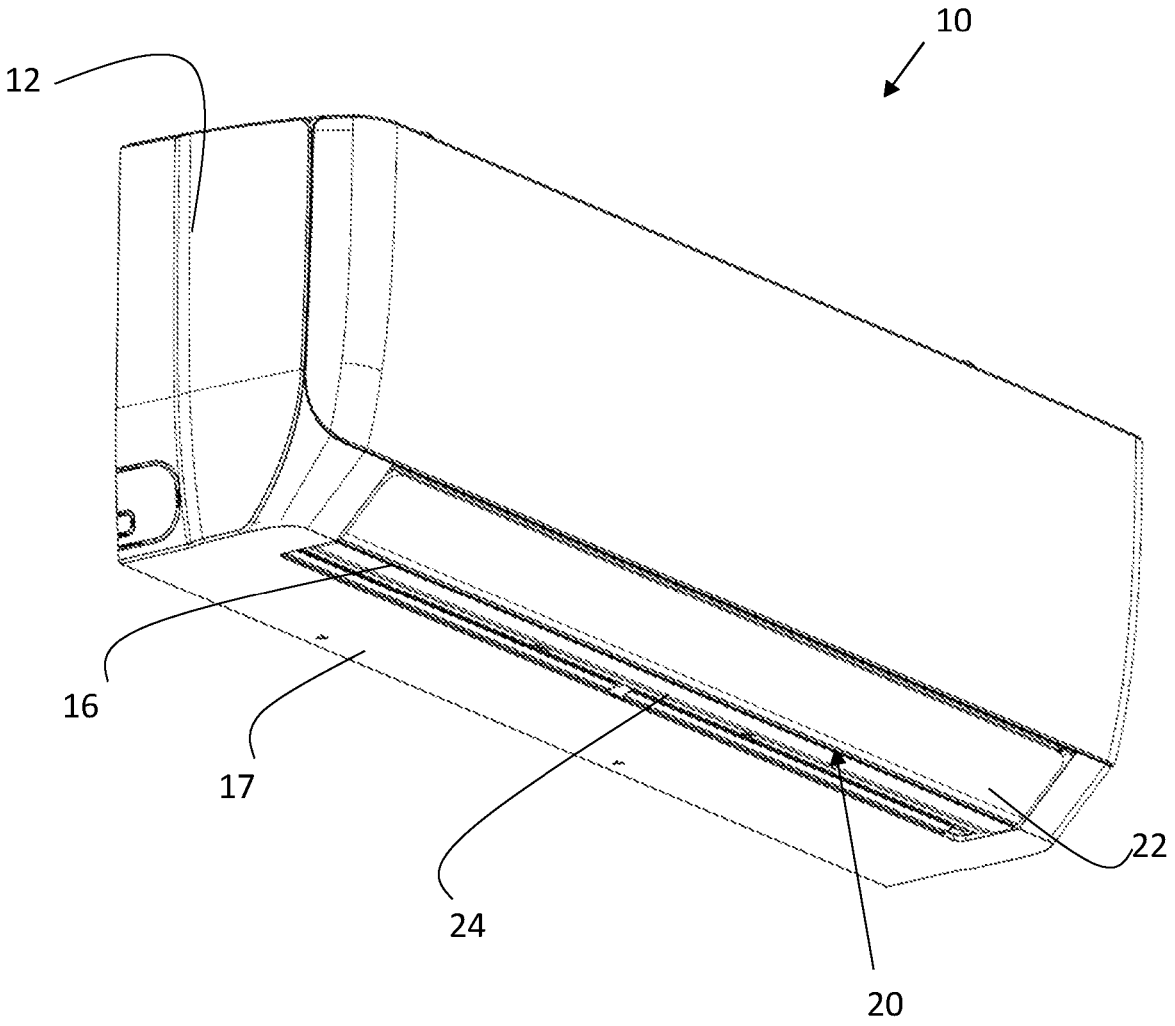
FIG. 1 is a view of an air conditioner with a louver arrangement.

In FIG. 1, a front view of an air-conditioner 10 is depicted. The air-conditioner 10 is in FIG. 1 an indoor unit of a split air conditioner, but the air-conditioner 10 could be any type of air conditioner. The air-conditioner 10 comprises a frame 12 housing the components of the air conditioner. The air conditioner typically comprises a fan configured to blow air out from the air conditioner 10 via an air outlet 16. The air outlet 16 is provided with a louver arrangement 20. The louver arrangement 20 can be moved using a displacement mechanism that is configured to move the louver into different positions.

When in use, the louver arrangement 20 can be moved between different positions using the displacement mechanism. This allows the air directing louver 20 to have a wide range of movement and thus, of air directing possibilities. The louver arrangement 20 of FIG. 1 comprises two louvers 22, 24 forming a dual louver arrangement as will be described in more detail below. The first louver 22 will be termed main louver 22 herein and the second louver 24 will be termed crank louver 24 herein.

Figure 2:
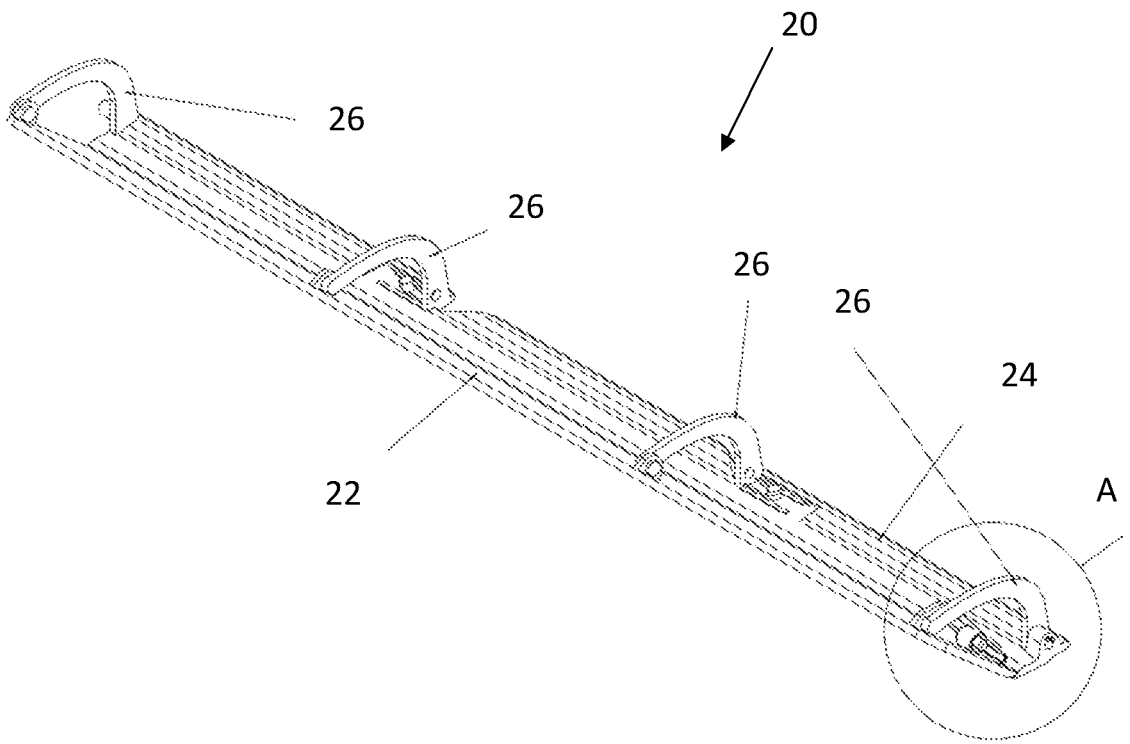
FIG. 2 is a view in perspective of a louver arrangement.

In FIG. 2 an exemplary embodiment of the louver arrangement 20 is shown disconnected from the air-conditioner. The main louver 22 and the crank louver 24 of the louver arrangement 20 are interconnected and driven by a displacement mechanism also termed drive mechanism 26. Thus, the main louver 22 and crank louver 24 move in a coordinated manner when the drive mechanism 26 is actuated. As is exemplified in FIG. 2, the drive mechanism 26 can be provided along the length of the main louver 22 at several locations. This will improve the stability of the louver mechanism. In some embodiments, parts of the drive mechanism are repeated at least two times or at least four times over the length of the main louver 22.

Figure 3:
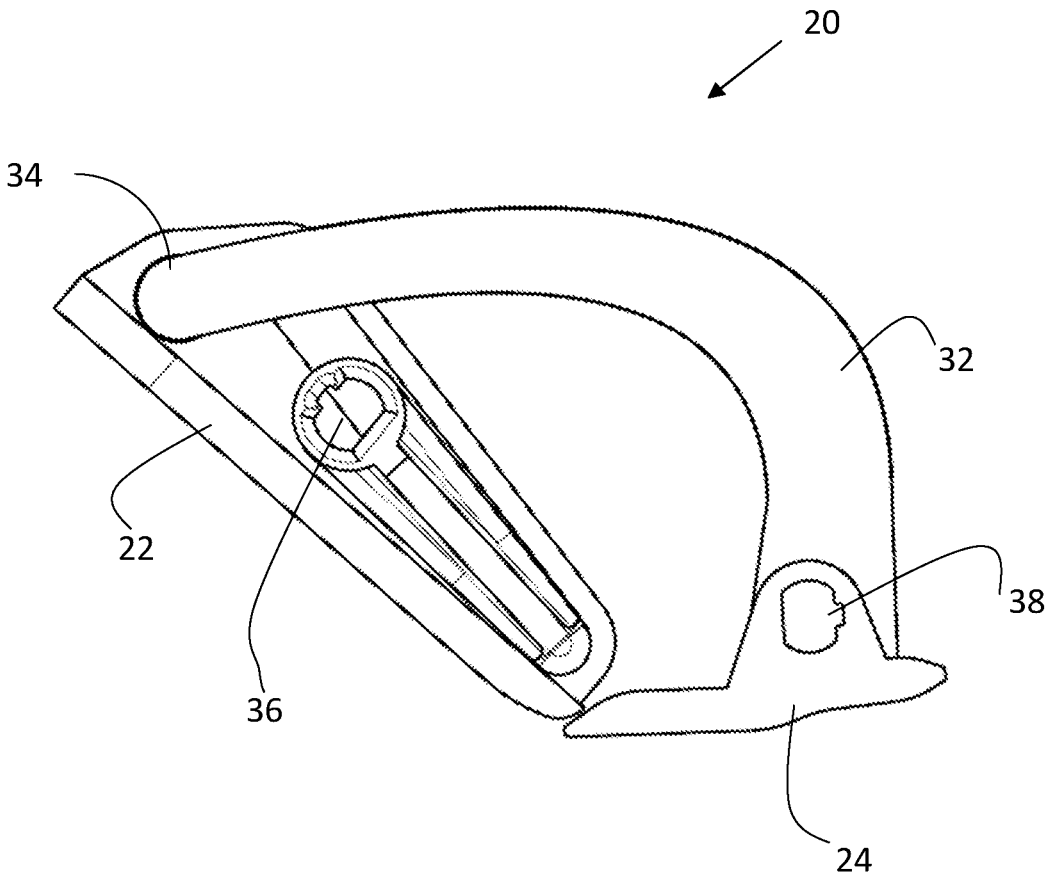
FIG. 3 is a cross sectional view from the side of a louver arrangement.

In FIG. 3, a sectional view from the side of the louver arrangement 20 at the section marked A in FIG. 2 is shown. The exemplary embodiment of FIG. 3 illustrates how the main part of the drive mechanism 26 can be implemented to make the main louver 2 and the crank louver 24 work together in cooperation. The main louver 22 and the crank louver 24 are in the exemplary embodiment interconnected by a crank 32. The crank can be rigidly connected to the crank louver 24. The crank 32 can be repeated multiple times over the length of the main louver as is shown in FIG. 2. In accordance with one embodiment the crank(s) 32 are integrated with the crank louver 24 and can for example be molded in one single piece. The connection between the crank 32 and the main louver is advantageously a rotating connection formed by a rotatable member 34. The rotating member 34 can be for example be formed by a pin or a screw. To move the louver arrangement between different positions two rotating members 36 and 38 can be provided. The first rotating member 36 can be provided to move the main louver 22 between different positions while the second rotating member 38 can be provided to move the crank louver 24 between different positions. In accordance with some embodiments the rotating members are motor driven. When the rotating members 36, 38 are motor driven the rotating members can be connected to the drive shaft of the motor or even be formed by the drive shaft of the motor.

Figure 4:
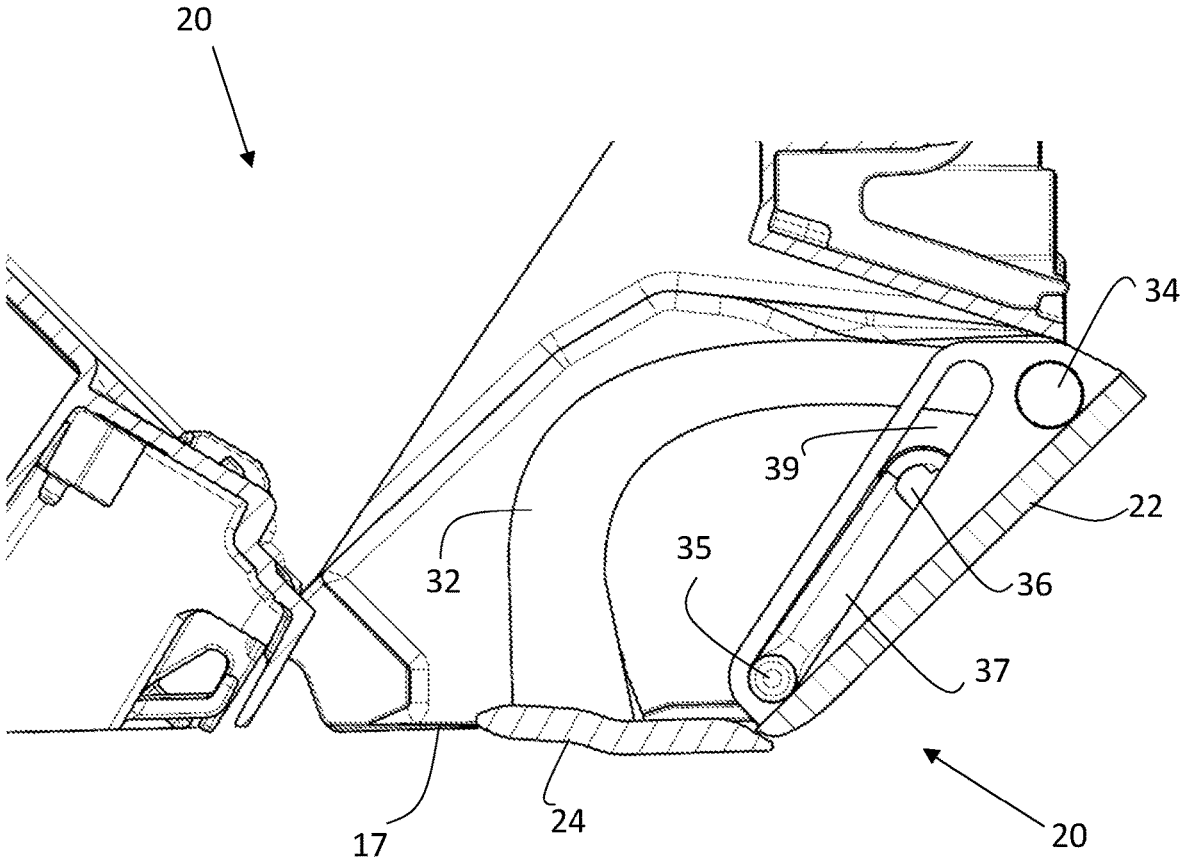
FIG. 4 is a cross sectional view from the side of a louver arrangement mounted in an air-conditioner.

In FIG. 4, the louver arrangement 20 is shown in a sectional view from the side when mounted at the air outlet from an air-conditioner 10. The crank louver 24 is positioned closer to a lower wall 17 of the air outlet than the main louver 22. Hereby it is achieved that the crank louver 24 can deflect a fraction of air flow onto the main louver 22 when in use on the air-conditioner 10. This will be described in more detail below. FIG. 4 further illustrates how the drive mechanism can be implemented. In the embodiment shown in FIG. 4 a slot 39 can be provided connected to the main louver 22. In the slot 39 a member 35 such as a pin 35 can move. The member 35 here the pin 35 is connected to a slide crank 37. The slide crank 37 is in turn driven by the rotating member 36. Hereby the rotation of the rotating member 36 can translate to a movement of the main louver as will be exemplified below.

Figure 5:
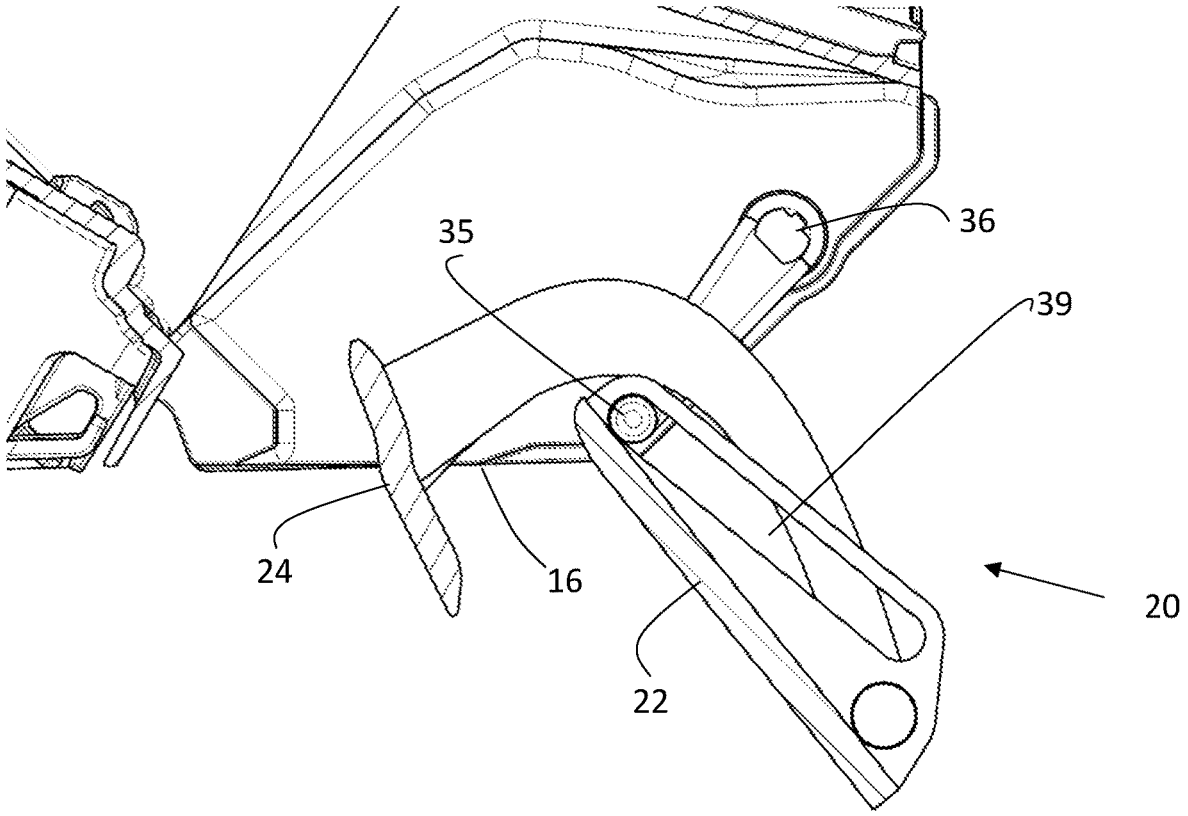
FIGS. 5-7 are cross sectional view from the side of a louver arrangement mounted in an air-conditioner when in different modes of operation, and FIG. 8. is a view in perspective of a louver arrangement with motors for driving the louver arrangement.

In FIG. 5, the louver arrangement 20 is shown moved to an opened position allowing air to exit the air outlet 16. The flexibility of movement provided by the mechanism as described herein allows the main louver 22 and the crank louver 24 to be positioned in a way where they cause a minimum of resistance to the outlet airflow, allowing the air conditioner to provide the maximum amount of air flow whereby the flow can be maximized.

Figure 6:
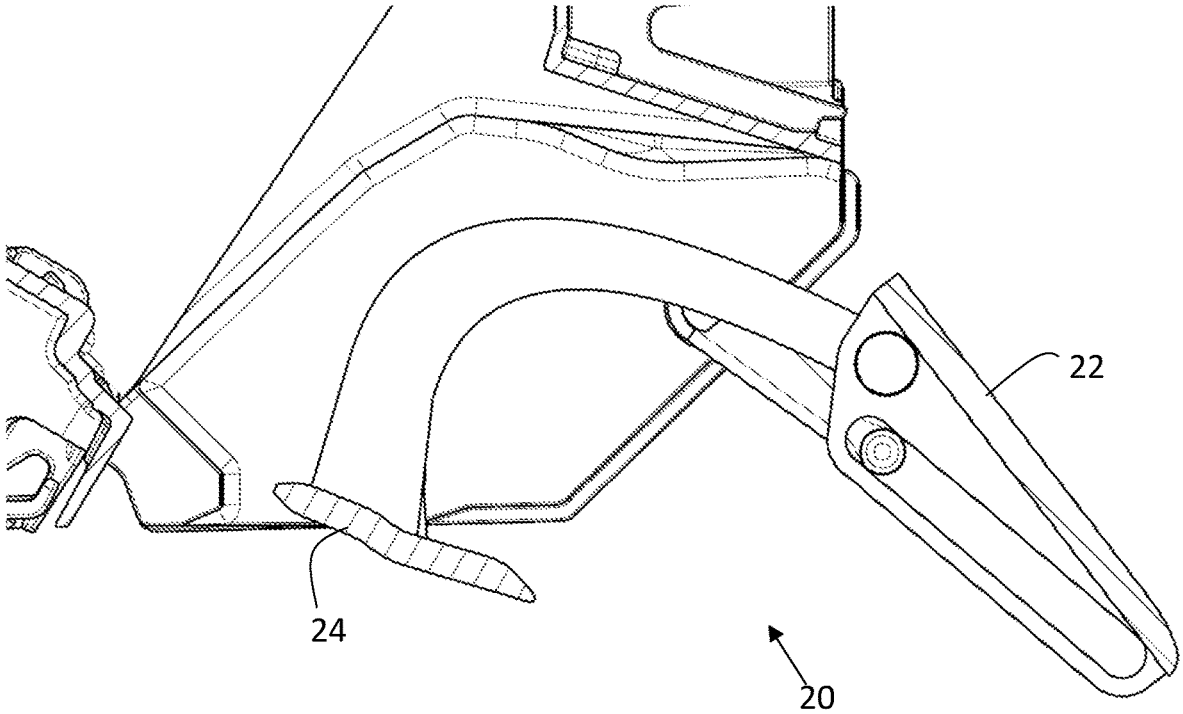

In FIG. 6, the louver arrangement 20 is shown moved to a position for use in a heating mode of the air-conditioner 10. The flexibility of movement provided by the mechanism as described herein allows the main louver 22 and the crank louver 24 to be positioned in a way where they can direct the air at very steep (close to vertical) downwards angle. This is beneficial because hot air is directed to the floor and then rises to the ceiling naturally, causing an even temperature distribution in the room. This position could also be used in cooling mode as a way of avoiding air blowing directly on the user.

Figure 7:
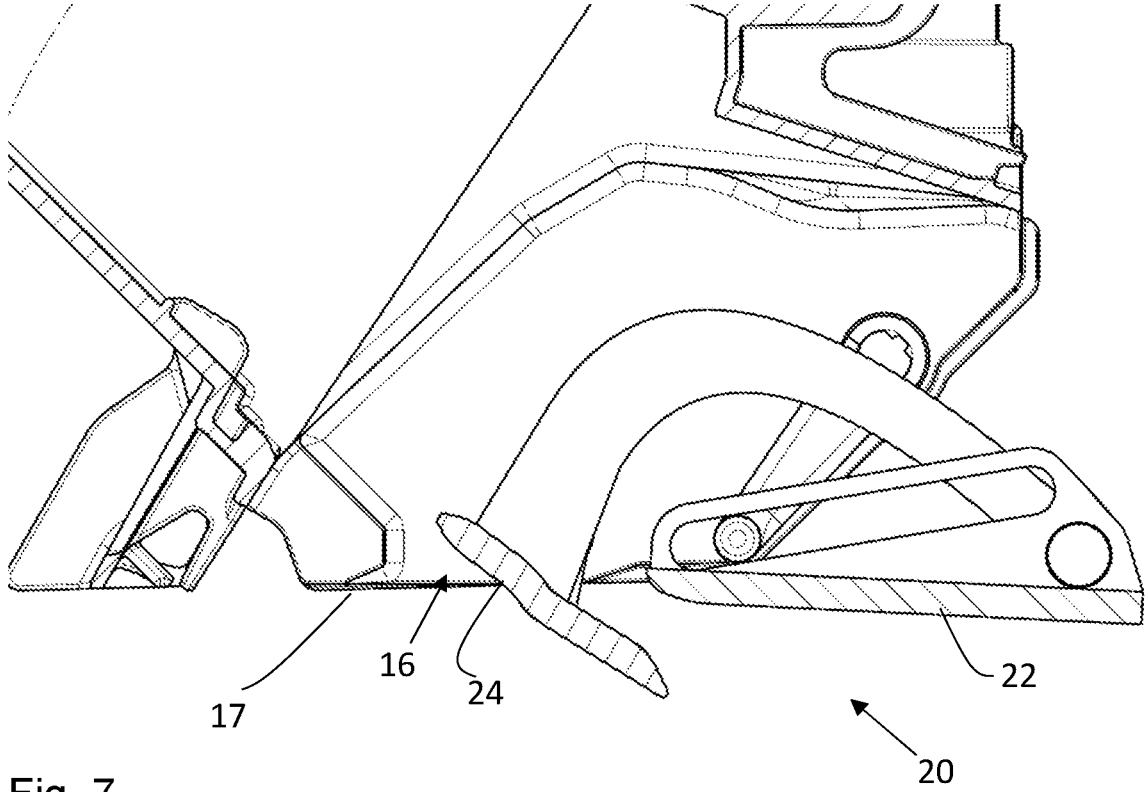

In FIG. 7, the louver arrangement 20 is shown moved to a position for use in a cooling mode of the air-conditioner 10. In a cooling mode cold air will exit the air outlet 16. The cold air will reduce the temperature of the surface of the main louver 22. When the air-conditioner is used in a humid environment, condensation will occur on the cold surface of the main louver 22. There is then a risk that water will start to drop from the main louver 22 which is typically not desired. To prevent (or at least reduce) such condensation on the main louver 22, the crank louver 24 is positioned to, at least in some positions such as the cooling mode position, deflect some air exiting the air outlet so that an air stream is made to pass over the surface of the main louver 22. By allowing air to flow over the surface of the main louver 22, humid air can be removed and no or less condensation occurs. This is obtained by locating the crank louver 24 closer to the lower wall 17 of the air-conditioner outlet than the main louver 22. Hereby the crank louver 24 can deflect a fraction of air flow exiting via the air outlet 16 onto the main louver when in use on the air-conditioner 10.

Further, condensation on the crank louver 24 can be reduced or eliminated by forming the crank louver 24 with a curved or bent shape as seen in a cross section from the side as in FIG. 7. Hereby air can be made to flow on both sides of the crank louver 24 when the crank louver is in some positions and in particular when the crank louver is in a position where the air-conditioner is in a cooling mode as in FIG. 7. The shape of the Crank louver 24 can for example be an S-shape as seen from the side or some other shape allowing air to flow on both sides of the crank louver 24.

Figure 8:
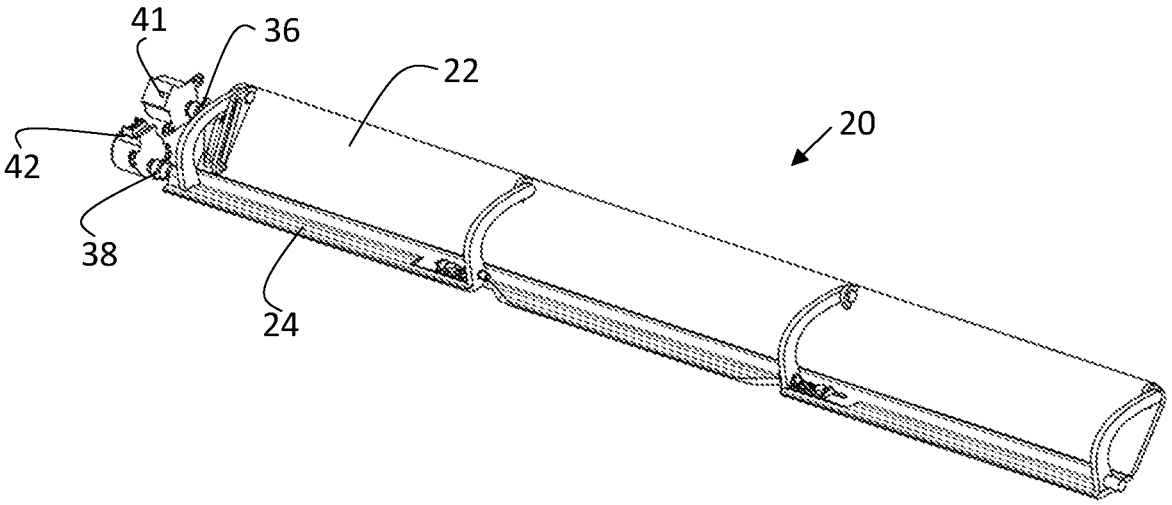

In FIG. 8 the louver arrangement 20 is shown driven by motors 41, 42. As set out above, the rotating members 36, 38 can be motor driven. Here the motor 41 drives the rotating member 36 that moves the main louver 24 and the motor 42 drives the rotating member 38 that moves the crank louver 24. The motors 41 and 42 can be stepper motors to allow for an accurate positioning of the louver arrangement 20 in response to a set mode of the air conditioner.

The invention claimed is:

1. A louver arrangement configured to be attached to an air-conditioner, the louver arrangement comprising:

a main louver configured to direct a main air flow from an air-conditioner outlet when mounted on an air-conditioner;

a crank louver rotatably connected to the main louver, wherein the crank louver is configured to be located closer to a lower wall of the air-conditioner outlet when mounted on the air-conditioner and configured to deflect a fraction of air flow from the air-conditioner outlet onto the main louver when in use on the air-conditioner;

a louver link connecting the main louver to the crank louver, a slot connected to the main louver; and a slide crank having a member at one end adapted to slide in the slot and a first rotating member at a second end configured to rotatably connect to a frame of the air conditioner.

2. The louver arrangement according to claim 1, further comprising a second rotating member attached to the louver link and configured to rotatably connect the louver link to a frame of the air conditioner.

3. The louver arrangement according to claim 2, wherein the first rotating member and/or the second rotating member is connected to a stepper motor.

4. The louver arrangement according to claim 1, wherein the crank louver has a bent cross-section.

5. The louver arrangement according to claim 4, wherein the crank louver has an S-shaped cross-section.

6. The louver arrangement according to claim 1, wherein the crank louver and the louver link are formed as an integrated element that is configured to secure to an air conditioner.

7. The louver arrangement according to claim 1, wherein at least two louver links are provided along a length of the main louver.

8. An air-conditioner comprising a louver arrangement according to claim 2.

9. An air-conditioner according to claim 8, wherein a stepper motor is connected to each of the first and second rotating member, and wherein both stepper motors are located at an end section of the louver arrangement.

10. An air conditioner comprising:

a frame having a fan housed in the frame and an air outlet configured to direct air from the fan out of the frame;

a louver arrangement comprising:

a main louver positioned at the air outlet, comprising a slot, and configured to direct air passing through the air outlet, a crank louver rotatably attached to the frame to pivot about a first axis and rotatably connected to the main louver and positioned at a lower wall of the air outlet when the air conditioner is mounted in an operating position, wherein the crank louver is configured to deflect air passing through the air outlet onto the main louver when in use on the air-conditioner, and at least one crank fixed to the crank louver and pivotally connected to the main louver; and a slide crank having a first end rotatably attached to the frame to pivot about a second axis and a second end slidingly connected to the slot, and wherein the second axis is parallel to and spaced from the first axis.

11. The air conditioner of claim 10, wherein the louver arrangement is configured to be attached as an assembly to the frame.

12. The air conditioner of claim 10, further comprising one or more motors to operate the louver arrangement to pivot the crank louver about the first axis and the slide crank about the second axis to move the main louver and the crank louver in unison between a closed position and an opened position.

13. The air conditioner of claim 12, wherein the one or more motors comprises at least one of a first motor drivingly attached to the crank louver and a second motor drivingly attached to the first end of the slide crank.

14. An air conditioner comprising:

a main louver configured to direct a main air flow from an air conditioner outlet;

a crank louver rotatably connected to the main louver, wherein the crank louver is configured to deflect a fraction of air flow from the air conditioner outlet onto the main louver when in use;

a louver link connecting the main louver to the crank louver;

a slot connected to the main louver;

a slide crank having a member at one end adapted to slide in the slot and a first rotating member at a second end configured to rotatably connect to a frame of the air conditioner; and a first stepper motor connected to the first rotating member.

15. The air conditioner of claim 14, further comprising a frame having a fan housed in the frame and an air outlet configured to direct air from the fan out of the frame.

16. The air conditioner of claim 15, further comprising a second rotating member attached to the louver link and configured to rotatably connect the louver link to a frame of the air conditioner.

17. The air conditioner of claim 16, wherein the second rotating member is connected to a stepper motor.

* * * * *